United States Patent [19]

Richter et al.

[11] Patent Number: 4,513,515

[45] Date of Patent: Apr. 30, 1985

[54] GAS TREATMENT OF PARTICULATE MATERIALS IN STORAGE CONTAINERS

[75] Inventors: Johan C. F. C. Richter, Oslo, Norway; Ole J. Richter, Karlstad, Sweden

[73] Assignee: Kamyr AB, Karlstad, Sweden

[21] Appl. No.: 468,716

[22] Filed: Feb. 22, 1983

[30] Foreign Application Priority Data

Feb. 25, 1982 [SE] Sweden ..... 8201165

[51] Int. Cl.[3] ..... F26B 3/16

[52] U.S. Cl. ..... 34/33; 34/164; 34/171; 34/178; 34/181; 366/108; 366/117

[58] Field of Search ..... 162/49, 68, 19, 47, 162/52, 18, 246, 238; 34/168, 171, 172, 173, 178, 179, 181, 182, 164, 33; 366/108, 113, 117, 118

[56] References Cited

U.S. PATENT DOCUMENTS

| | | | |
|---|---|---|---|
| 2,794,267 | 6/1957 | Louis et al. | 34/171 |
| 3,710,453 | 1/1973 | Whelpley | 34/164 |
| 4,124,440 | 11/1978 | Sherman . | |
| 4,274,911 | 6/1981 | Kroneld et al. | 162/47 |

FOREIGN PATENT DOCUMENTS

| | | | |
|---|---|---|---|
| 049992 | 4/1982 | European Pat. Off. . | |
| 504770 | 8/1930 | Fed. Rep. of Germany | 34/178 |
| 2336374 | 2/1974 | Fed. Rep. of Germany . | |

*Primary Examiner*—Larry I. Schwartz

*Attorney, Agent, or Firm*—Cushman, Darby & Cushman

[57] ABSTRACT

A vertical container holds and treats particulate material, such as comminuted cellulosic fibrous material like wood chips. The container includes a vertical interior wall, an open top, and a discharge outlet at the bottom. A top interior wall structure directs particulate material to a first false bottom concentric with it. The first false bottom is mounted for oscillation with respect to the vertical container and discharges particulate material through a discharge opening in the generally conical bottom thereof into a second false bottom structure. The second false bottom structure also includes a generally conical bottom with a discharge opening, and is also mounted for oscillation with respect to the container. Steam is preferably introduced into the second false bottom to effect steaming of the particulate material within it, and the container is held at super-atmospheric pressure.

21 Claims, 2 Drawing Figures

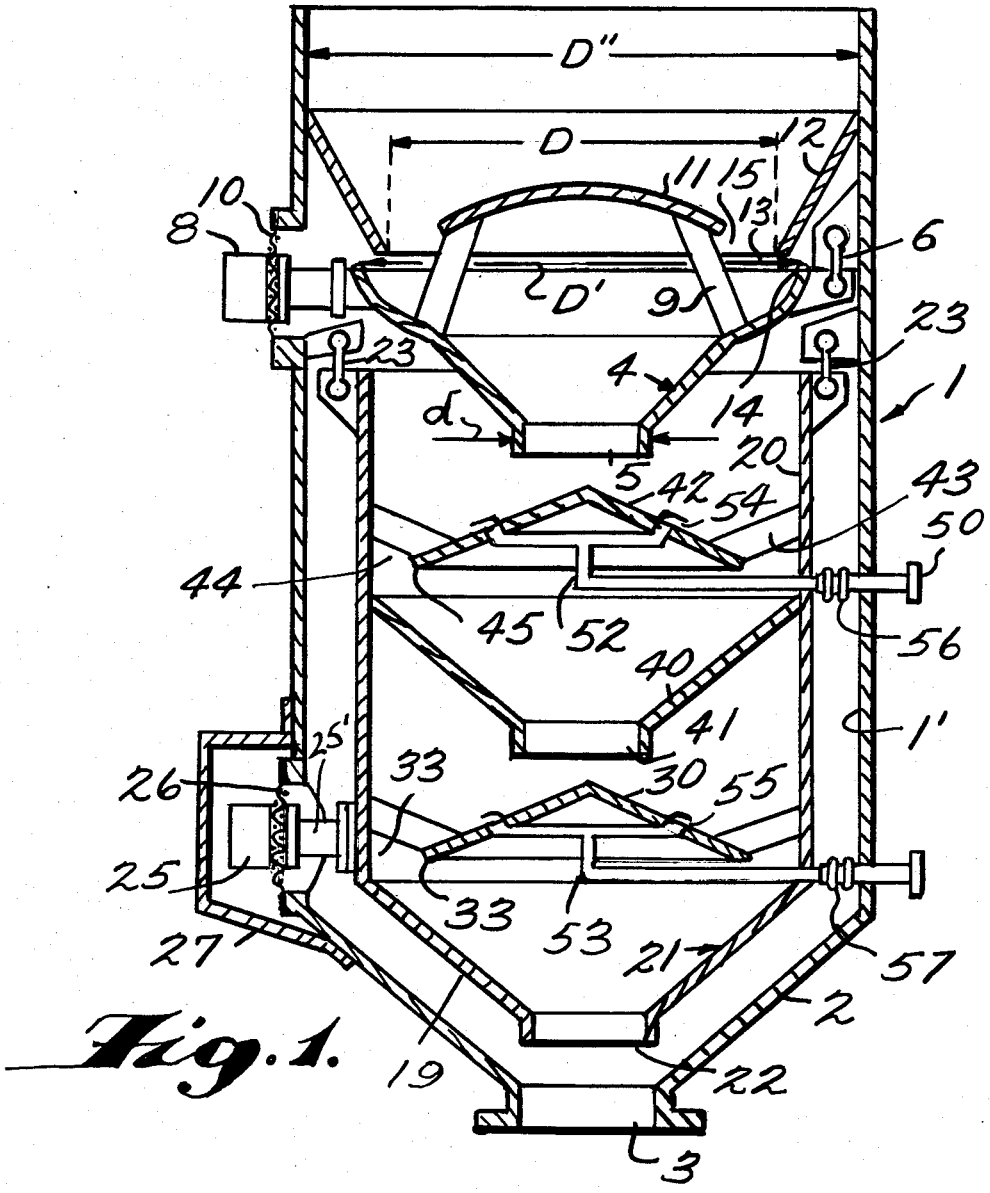
Fig. 1.
Fig. 2.
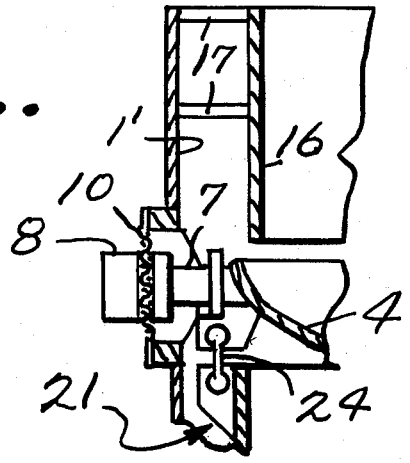

GAS TREATMENT OF PARTICULATE MATERIALS IN STORAGE CONTAINERS

BACKGROUND AND SUMMARY OF THE INVENTION

The invention relates to an assembly for holding and/or treating particulate material. The invention is particularly applicable to the treatment of comminuted cellulosic material, such as wood chips for the production of paper pulp. Wood chips, and other like particulate materials, have a tendency to hang-up in a container when funnelled down to a discharge opening at the container bottom. In order to alleviate this problem a vibratory structure is conventionally provided at the container discharge opening, such a structure being shown in U.S. Pat. No. 4,124,440, the disclosure of which is hereby incorporated by reference herein. Also in the pulp and paper industry it is convenient to effect steaming of the wood chips, or the like, when within the storage container, commonly referred to as a "chips bin".

According to the present invention a storage container is provided for particulate material, particularly cellulosic fibrous particulate material such as wood chips, which is eminently effective in preventing hang-ups of particulate material therein. The discharge is effective, according to the present invention, without the necessity of an exterior rubber seal between a vibratory discharge component and stationary container, such as is present in the conventional prior art, and the invention is particularly applicable to containers having large dimensions (e.g. diameters of about 5–10 meters), and performs its intended function over long periods of time without substantial down-time.

Utilizing the invention it is also possible to effectively introduce a treatment fluid into the material being passed therethrough. Particularly where the particulate material is cellulosic fibrous material, such as wood chips, a treatment fluid such as steam is desirably introduced in the storage container itself to effect pre-treatment of the material before passing onto other stages in a pulping process.

The invention also relates to a method of handling particulate material, particularly cellulosic fibrous material such as wood chips, in an effective manner to provide effective discharge thereof. The method according to the invention is particularly directed to the steaming of the cellulosic fibrous material as it passes through a container.

It is the primary object of the present invention to provide an assembly and method for the effective discharge, and/or treatment, of particulate material through and from a container. This and other objects of the invention will become clear from an inspection of the detailed description of the invention, and from the appended claims.

BRIEF DESCRIPTION OF THE DRAWINGS

FIG. 1 is a vertical cross-sectional view of an exemplary assembly according to the present invention, with some components being shown in elevation; and FIG. 2 is a vertical cross-sectional view of a portion of a modified assembly according to the present invention.

DETAILED DESCRIPTION OF THE DRAWINGS

The assembly according to the present invention is particularly useful as a chips bin for the storage, discharge, and steaming comminuted cellulosic fibrous material for paper pulp production, but also has other uses.

An exemplary container according to the present invention is shown generally by reference numeral 1 in the drawings. The container 1 is vertical, having a vertical interior wall 1', and has a substantially circular cross-section. The container 1 has an opening at the top thereof into which particulate material, such as comminuted cellulosic fibrous materials like wood chips, is fed, and at the bottom has a conical portion 2 terminating in a discharge opening 3 at the bottom center of the container 1.

Located at a vertically intermediate portion of the container 1 is a first false bottom 4, which is generally conical in shape, and has a central bottom discharge opening 5 concentric with the opening 3. Means are provided for mounting the false bottom 4 for oscillatory movement with respect to the container 1. Such means include a plurality of flexible mounts 6 located at predetermined spaces around the periphery of the false bottom discharge structure 4, one or more arms 7, and a vibration power source 8 for effecting the actual oscillation of the member 4. A suitable flexible seal 10 is preferably provided between the container 1 wall and the vibration power source 8.

A plurality of arms 9 connect a distributing member 11 to the first false bottom member 4. The distributing member 11 has an apex at the central portion thereof, concentric with the centers of the openings 3, 5, and may comprise a spherical section—as illustrated in FIG. 1—or it may be conical.

Near a top portion of the container 1 is a top interior wall structure 12. The structure 12 in the embodiment illustrated in FIG. 1 comprises an annular conical member having an open top with a diameter D'' and an open bottom with a diameter D, and terminating in an edge 13. An annular space 15 is defined between the distributing member 11 and the interior wall structure 12. The diameter D is less than the diameter D' of the open top of the first false bottom member 4, the open top being defined by the edge 14. The edges 13, 14 are preferably at about the same vertical level, and the illustrated arrangement insures deposition of particulate material from the top of the container into the vibrating false bottom 4.

An alternative form that the top interior wall structure can take is illustrated in FIG. 2. In this embodiment the top interior wall structure comprises an interior tubular member 16 having a diameter D, and connected to the wall 1' by a plurality of radially extending, vertically spaced, support arms 17.

A second distributing means comprising a second false bottom 21 also is provided in the container 1. The second false bottom 21 includes a bottom generally conical portion 19 terminating in a small diameter discharge opening 22 concentric and in-line with the openings 3, 5, and includes a top elongated tubular wall 20. Means are provided for mounting the second false bottom member 21 for oscillation with respect to the container 1. In the embodiment illustrated in FIG. 1 such means comprise a plurality of flexible supports 23 mounted between the elongated tubular component 20 and the interior vertical wall 1', and one or more arms 25' mounted to a vibration source 25 with flexible seal 26 provided between the vibration source 25 and the container 1. The vibration source 25 operates independently of the vibration source 8, that is it can effect oscillation of the second false bottom 21 at a different frequency and amplitude than the first false bottom 4. Preferably a housing 27 sealed to the exterior of the container 1' is provided surrounding the vibration source 25. Under some circumstances the structure 25 is itself radially outward of the diameter D", but upon utilization of a suitable vibrator source it may be mounted interiorly of the diameter D". The vibration source 25 must be of the type capable of withstanding adverse environmental conditions such as will exist in the container 1 as hereinafter described.

An alternative form of the means for mounting the second false bottom 21 for oscillation is illustrated in FIG. 2. In this embodiment flexible connectors 24 are provided between the portion 20 of the second false bottom 21 and arms 7 of the vibration source for oscillating the first false bottom 4 (i.e. operatively connected to the first false bottom 4). In this way the second false bottom 21 will oscillate with the same amplitude and frequency as the first false bottom 4.

The assembly according to the present invention also preferably comprises means for introducing steam into the interior of the volume defined by the second false bottom 21. One form such steam introduction means can take, as illustrated in FIG. 1, comprises a distributor cone 30 operatively mounted by arms 31 to the interior of the second false bottom 21 adjacent the bottom thereof, so that the apex of the cone is vertically in-line with the openings 5, 3. An annular space 32 is defined between the radially outwardmost edge 33 of the conical distributor 30 and the interior of the tubular wall portion 20. Steam introduction is provided from a source 51 exterior of the container 1 through conduit 53, which passes beneath the cone 30 and introduces steam upwardly into the interior of the portion 20 through a plurality of openings 55 formed in the cone 30. A flexible connector 57 is provided between the conduit 53 and the source 51 to allow oscillation of the structure 21.

Steam introduction can also be facilitated utilizing the third false bottom member 40, having bottom discharge opening 41, which is located between the false bottoms 4, 21 and is fixed to the tubular portion 20. In this case also a conical distributing member 42 is provided mounted to the portion 20 by arms 43, with an annular space 44 being defined between the cone 42 and the interior of wall portion 20 and the edge 45 of the cone 42. Steam is introduced from source 50 by conduit 52 passing beneath the cone and passing upwardly through a plurality of openings 54 defined in the cone 42. A flexible connection 56 connects the conduit 52 to the source 50. If desired, the cone supporting function and the steam conduit function can be combined, as shown in said U.S. Pat. No. 4,124,440.

The provision of the structure illustrated in FIG. 1 provides for enhanced distribution of the particulate material, and even treatment by the introduced steam, and insures that there will be no material "hang-ups", or steam "channelling" during passage of the particulate material through the container 1.

In operation of the assembly according to the invention, wood chips, or the like, are introduced into the top of the container 1, and passed downwardly therein, directed by the top interior wall structure 12 into the open top of the conical first false bottom 4. The false bottom 4 vibrates, and material is caused to pass through the annular channel 15 into the false bottom 4, and through the discharge opening 5 at the bottom thereof, without hang-ups. Steam is introduced through the openings 50, 51 and conduits 52, 53 to flow upwardly within the second false bottom 21 to treat the wood chips as they pass, in turn, through the annular space 44 into third false bottom 40 and then through discharge opening 41, and through annular space 32 into the conical bottom portion 19 of the second false bottom 21 and then through discharge opening 22 immediately above container discharge opening 3. The container may be maintained at super-atmospheric pressure during passageway of the wood chips therethrough (e.g. about 1–2 bars guage). Any wood chips inadvertently falling out of the first false bottom 4 will pass between the container wall 1' and the exterior of the tubular portion 20 of the second false bottom 21, and be guided by the conical bottom 2 of the container 1 through the discharge outlet 3.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A bin assembly for particulate material, comprising:

a vertical substantially cylindrical container having a vertical interior wall, a feed inlet at the top, and a particulate material discharge at the bottom;

a top interior wall structure of said container, having a bottom opening of diameter D;

a generally conical, generally rigid, first false bottom including an open top portion having a diameter D', wherein D' is greater than D, and having a bottom discharge opening of diameter d, wherein d is much less than D;

means for mounting said first false bottom beneath said top interior wall structure so that said diameters D and D' are substantially concentric, and for mounting said first false bottom for oscillation with respect to said top interior wall structure and said container, and so that said false bottom is a substantial distance above said container discharge opening;

a second generally conical, generally rigid, false bottom;

means for mounting said second false bottom so that it is below said first false bottom, and just above said container discharge outlet, and for mounting said second false bottom for oscillatory movement; and power means for oscillating said first and second false bottoms.

2. An assembly as recited in claim 1 further comprising: a distributing member having a high point and a low point; and a plurality of arms mounting said distributing member to said first false bottom so that said distributing member is concentric with said first false bottom and the high point thereof extends upwardly out of said first false bottom into the volume defined by said top interior wall structure, an annular particulate material passageway being provided between said distributing member and said top interior wall structure.

3. An assembly as recited in claim 2 wherein said top interior wall structure comprises an annular conical member having a large diameter top portion and a small diameter bottom portion, said bottom portion having said diameter D, and said top portion fixed to the interior of said container.

4. An assembly as recited in claim 2 wherein said top interior wall structure comprises a tubular wall member concentric with said vertical container interior wall and mounted interiorly of said container interior wall and substantially concentric therewith, said interior tubular member having a substantially constant interior diameter D.

5. An assembly as recited in claim 3 wherein said container interior vertical wall has a diameter of D″, wherein D″ is greater than D′.

6. An assembly as recited in claim 4 wherein said container interior vertical wall has a diameter of D″, wherein D″ is greater than D′.

7. An assembly as recited in claim 1 wherein said means for mounting said second false bottom for oscillation comprises means for mounting said second false bottom to said first false bottom.

8. An assembly as recited in claim 1 wherein said means for mounting said second false bottom for oscillation comprises means for mounting said second false bottom for oscillation independently of said first false bottom.

9. An assembly as recited in claim 8 wherein said power means is mounted within a housing in sealed relationship with said vertical container, and connected thereto.

10. An assembly as recited in claim 9 wherein said power means is radially exterior of said vertical container vertical interior wall.

11. An assembly as recited in claim 1 further comprising means for introducing steam into the interior of said second false bottom to effect steaming of the particulate material passing downwardly therein.

12. An assembly as recited in claim 11 wherein said second false bottom includes an upper elongated tubular portion; and wherein said means for introducing steam introduces steam at at least two different vertical locations within said second false bottom.

13. An assembly as recited in claim 11 wherein said means for introducing steam includes a conical distributing member concentric with said second false bottom discharge; conduit means for transporting steam from a source exterior of said container to the interior thereof, said conduit means including a portion thereof passing under said conical distributor member; and means defining a plurality of openings in a top surface of said conical distributing member.

14. An assembly as recited in claim 2 wherein said second false bottom includes an elongated tubular top portion; and further comprising a third false bottom mounted within said second false bottom, and to said elongated tubular portion of said second false bottom, said third false bottom comprising: a conical member having an open top and a smaller discharge opening concentric with said first and second false bottom discharge openings; and a distributor cone operatively associated with each of said second and third false bottoms, said distributor cone associated with said third false bottom mounted just below said first false bottom discharge opening, and said second false bottom distributor cone mounted just below said third false bottom discharge opening.

15. An assembly as recited in claim 14 further comprising means for introducing steam to the interior of said second false bottom, said steam introducing means associated with both said second false bottom distributor cone and said third false bottom distributor cone.

16. A method of treating particulate material utilizing a vertical container having an interior vertical wall, and first and second generally conical, generally rigid, oscillatable false bottoms mounted within said vertical container concentric with said interior vertical wall and having enlarged open tops and smaller discharge openings in the open bottoms thereof, said method comprising the steps of:

introducing particulate material into an open top portion of the vertical container;

effecting oscillation of the first false bottom to effect discharge of particulate material thereabove into the second false bottom; and effecting discharge of particulate material from the second false bottom by effecting oscillation of the second false bottom, the particulate material being discharged through the discharge opening at the bottom of the vertical container.

17. A method as recited in claim 16 comprising the further step of maintaining superatmospheric pressure within said container.

18. A method as recited in claim 17 wherein the particulate material is comminuted cellulosic fibrous material, such as wood chips or the like: and comprising the further step of introducing steam into the second false bottom of the container, the steam effecting steaming of said comminuted cellulosic fibrous material.

19. A method as recited in claim 18 wherein said steps of oscillating the first false bottom and oscillating the second false bottom are accomplished coincidently, with the same amplitude and frequency of vibration and utilizing the same power source.

20. A method as recited in claim 18 wherein said steps of oscillating the first and second false bottoms are accomplished by oscillating the first false bottom with a different amplitude and frequency than the second false bottom, and utilizing a different power source.

21. An assembly for treating particulate material comprising:

a vertical container having a vertical interior wall;

a first generally conical discharge means;

a second discharge means having a generally conical bottom and having an elongated tubular top portion;

means for mounting said first and second discharge means within said vertical container so that they are substantially concentric with said container, and have discharge openings substantially concentric with a discharge opening disposed at the bottom of said vertical container;

means for oscillating said first and second discharge means within said container;

a distributing member mounted to each of said discharge means and including a peak portion disposed along a center line of the discharge openings and vertically above the discharge opening with which it is associated, and defining an annular space between said distributing member and said generally conical discharge portion; and means for introducing treatment fluid to the interior of said second discharge means to effect treatment of particulate material therein.

* * * * *